US008743024B2

(12) United States Patent
Kim

(10) Patent No.: US 8,743,024 B2
(45) **Date of Patent: *Jun. 3, 2014**

(54) EMISSION CONTROL DRIVER AND ORGANIC LIGHT EMITTING DISPLAY USING THE SAME

(75) Inventor: Dong-Hwi Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 324 days.

This patent is subject to a terminal disclaimer.

(21) Appl. No.: 13/014,595

(22) Filed: Jan. 26, 2011

(65) Prior Publication Data

US 2012/0062608 A1 Mar. 15, 2012

(30) Foreign Application Priority Data

Sep. 14, 2010 (KR) ..... 10-2010-0089945

(51) Int. Cl.
*G09G 3/30* (2006.01)

(52) U.S. Cl.
USPC ..... 345/76; 345/82; 315/169.3

(58) Field of Classification Search
USPC ..... 345/76–104, 204–215, 690–699; 315/169.1–169.4; 377/64–81
See application file for complete search history.

(56) References Cited

U.S. PATENT DOCUMENTS

| | | | | |
|---|---|---|---|---|
| 2004/0196239 | A1* | 10/2004 | Kwon | 345/92 |
| 2006/0227094 | A1* | 10/2006 | Park et al. | 345/100 |
| 2007/0018918 | A1* | 1/2007 | Chung | 345/76 |
| 2007/0040786 | A1* | 2/2007 | Chung | 345/92 |
| 2009/0040203 | A1* | 2/2009 | Kim et al. | 345/204 |
| 2009/0225068 | A1* | 9/2009 | Jeong et al. | 345/211 |

FOREIGN PATENT DOCUMENTS

| | | | |
|---|---|---|---|
| KR | 10-2007-0049906 | A | 5/2007 |
| KR | 10-2007-0100545 | A | 10/2007 |
| KR | 10-0805538 | B1 | 2/2008 |
| KR | 10-2008-0027062 | A | 3/2008 |
| KR | 10-2008-0033630 | A | 4/2008 |

* cited by examiner

*Primary Examiner* — Abbas Abdulselam
(74) *Attorney, Agent, or Firm* — Christie, Parker & Hale, LLP

(57) ABSTRACT

There is provided an emission control driver including a first signal processing unit for receiving an input power from an input power source, a main input signal, and a sub input signal, and for outputting a first output signal and a second output signal, a second signal processing unit for receiving the first output signal, the second output signal, and a clock signal, and for outputting a third output signal, and a third signal processing unit for receiving the first output signal and the second output signal, and for outputting an emission control signal. The width of the emission control signals may be freely controlled and the emission control driver having a simple structure, and the organic light emitting display using the same, may be provided.

15 Claims, 4 Drawing Sheets

EMISSION CONTROL DRIVER AND ORGANIC LIGHT EMITTING DISPLAY USING THE SAME

CROSS-REFERENCE TO RELATED APPLICATION

This application claims priority to and the benefit of Korean Patent Application No. 10-2010-0089945, filed on Sep. 14, 2010, in the Korean Intellectual Property Office, the entire content of which is incorporated herein by reference.

BACKGROUND OF INVENTION

1. Field of Invention

Embodiments of the present invention relate to an emission control driver and an organic light emitting display using the same.

2. Description of Related Art

Recently, various flat panel displays (FPDs) capable of reducing weight and volume that are disadvantages of cathode ray tubes (CRTs) have been developed. FPDs include liquid crystal displays (LCDs), field emission displays (FEDs), plasma display panels (PDPs), and organic light emitting displays.

Among FPDs, organic light emitting displays display an image using organic light emitting diodes (OLEDs) that generate light by re-combination of electrons and holes. Organic light emitting displays have high response speed and are driven with low power consumption. Common organic light emitting displays supply current corresponding to data signals to the OLEDs using transistors formed in pixels so that light is emitted by the OLEDs.

Conventional organic light emitting displays include a data driver for supplying the data signals to data lines, a scan driver for sequentially supplying scan signals to scan lines, an emission control driver for supplying emission control signals to emission control lines, and a display unit including a plurality of pixels coupled to the data lines, scan lines, and emission control lines.

The pixels included in the display unit are selected to receive the data signals from the data lines when the scan signals are supplied to the scan lines. The pixels that receive the data signals generate light (e.g., light components) with brightness (e.g., predetermined brightness components) corresponding to the data signals, and display an image (e.g., a predetermined image). Here, emission times of the pixels correspond to the emission control signals supplied from the emission control lines. In general, the emission control signals are supplied to overlap the scan signals supplied to the scan lines to set the pixels to which the data signals are supplied in a non-emission state.

Currently, research relating to setting an optimal brightness of an organic light emitting display is ongoing. The brightness of a panel may be controlled through various methods. For example, a bit of data is controlled to correspond to an amount of external light so that the brightness of the panel may be controlled. However, in order to control the bit of data, complicated processes are performed.

SUMMARY

Accordingly, embodiments of the present invention provide an emission control driver capable of freely controlling the width of emission control signals and having a simple structure, and an organic light emitting display using the same.

In order to achieve the foregoing and/or other aspects of embodiments of the present invention, an emission control driver according to one embodiment of the present invention includes a first signal processing unit for receiving an input power from an input power source, a main input signal, and a sub input signal, and for outputting a first output signal and a second output signal, a second signal processing unit for receiving the first output signal, the second output signal, and a clock signal, and for outputting a third output signal, and a third signal processing unit for receiving the first output signal and the second output signal, and for outputting an emission control signal.

The signal processing units may be coupled to a driving power source, and the first and third signal processing units may be coupled to a ground power source.

The input power source may be the same as the ground power source.

The first signal processing unit may include a first transistor including a gate electrode configured to receive the sub input signal, a first electrode coupled to a first node, and a second electrode coupled to the input power source, a second transistor including a gate electrode configured to receive the main input signal, a first electrode coupled to the first node, and a second electrode coupled to a driving power source, a third transistor including a gate electrode coupled to the first node, a first electrode coupled to the driving power source, and a second electrode, a fourth transistor including a gate electrode coupled to the first node, a first electrode coupled to the second electrode of the third transistor, and a second electrode coupled to a second node, and a fifth transistor including a gate electrode configured to receive the main input signal, a first electrode coupled to the second node, and a second electrode coupled to a ground power source, wherein the first output signal is configured to be output to the first node, and wherein the second output signal is configured to be output to the second node.

The second signal processing unit may include a sixth transistor including a gate electrode coupled to the first node, a first electrode coupled to the driving power source, and a second electrode coupled to a third node, a seventh transistor including a gate electrode coupled to the second node, a first electrode coupled to the third node, and a second electrode configured to receive the clock signal, and a first capacitor coupled between the second node and the third node, wherein the third output signal is output to the third node.

The third signal processing unit may include an eighth transistor including a gate electrode coupled to the second node, a first electrode coupled to the driving power source, and a second electrode coupled to a fourth node, a ninth transistor including a gate electrode coupled to the first node, a first electrode coupled to the fourth node, and a second electrode coupled to the ground power source, and a second capacitor coupled between the first node and the fourth node, wherein the emission control signal is output to the fourth node.

The second signal processing unit may include a first transistor including a gate electrode coupled to a first node, a first electrode coupled to a driving power source, and a second electrode coupled to a third node, a second transistor including a gate electrode coupled to a second node, a first electrode coupled to the third node, and a second electrode configured to receive the clock signal, and a first capacitor coupled between the second node and the third node, wherein the third output signal is output to the third node.

The third signal processing unit may include an eighth transistor including a gate electrode coupled to a second node, a first electrode coupled to a driving power source, and a second electrode coupled to a third node, a ninth transistor including a gate electrode coupled to a first node, a first electrode coupled to the third node, and a second electrode coupled to a ground power source, and a second capacitor coupled between the first node and the third node, wherein the emission control signal is output to the third node.

An organic light emitting display according to another embodiment of the present invention includes a display unit including pixels coupled to scan lines, emission control lines, data lines, a first power source, and a second power source, a scan driver for supplying scan signals to the pixels through the scan lines, an emission control driver including a plurality of stages coupled to the emission control lines and for supplying emission control signals to the pixels through the emission control lines, and a data driver for supplying data signals to the pixels through the data lines, wherein each of the stages includes a first signal processing unit for receiving an input power source, a main input signal, and a sub input signal, and for outputting a first output signal and a second output signal, a second signal processing unit for receiving the first output signal, the second output signal, and a clock signal and for outputting a third output signal, and a third signal processing unit for receiving the first output signal and the second output signal, and for outputting an emission control signal.

Each of the signal processing units may be coupled to a driving power source and the first and third signal processing units may be coupled to a ground power source.

The input power source may be the same as the ground power source.

An $i^{th}$ stage (i is a natural number) from among the plurality of stages may be configured to output the third output signal as the main input signal of an $(i+1)^{th}$ stage from among the plurality of stages.

The first signal processing unit may include a first transistor including a gate electrode configured to receive the sub input signal, a first electrode coupled to a first node, and a second electrode coupled to the input power source, a second transistor including a gate electrode configured to receive the main input signal, a first electrode coupled to the first node, and a second electrode coupled to a driving power source, a third transistor including a gate electrode coupled to the first node, a first electrode coupled to the driving power source, and a second electrode, a fourth transistor including a gate electrode coupled to the first node, a first electrode coupled to the second electrode of the third transistor, and a second electrode coupled to a second node, and a fifth transistor including a gate electrode configured to receive the main input signal, a first electrode coupled to the second node, and a second electrode coupled to a ground power source, wherein the first output signal is output to the first node, and wherein the second output signal is output to the second node.

The second signal processing unit may include a first transistor including a gate electrode coupled to a first node, a first electrode coupled to a driving power source, and a second electrode coupled to a third node, a second transistor including a gate electrode coupled to a second node, a first electrode coupled to the third node, and a second electrode configured to receive the clock signal, and a first capacitor coupled between the second node and the third node, wherein the third output signal is output to the third node.

The third signal processing unit may include an first transistor including a gate electrode coupled to a second node, a first electrode coupled to a driving power source, and a second electrode coupled to a third node, a second transistor including a gate electrode coupled to the first node, a first electrode coupled to the third node, and a second electrode coupled to a ground power source, and a second capacitor coupled between the first node and the third node, wherein the emission control signal is output to the third node.

As described above, according to embodiments of the present invention, the width of the emission control signals may be freely controlled, and the emission control driver having a simple structure, and the organic light emitting display using the same, may be provided.

BRIEF DESCRIPTION OF THE DRAWINGS

The accompanying drawings, together with the specification, show exemplary embodiments of the present invention, and, together with the description, serve to explain aspects of embodiments of the present invention.

DETAILED DESCRIPTION

Figure 1:
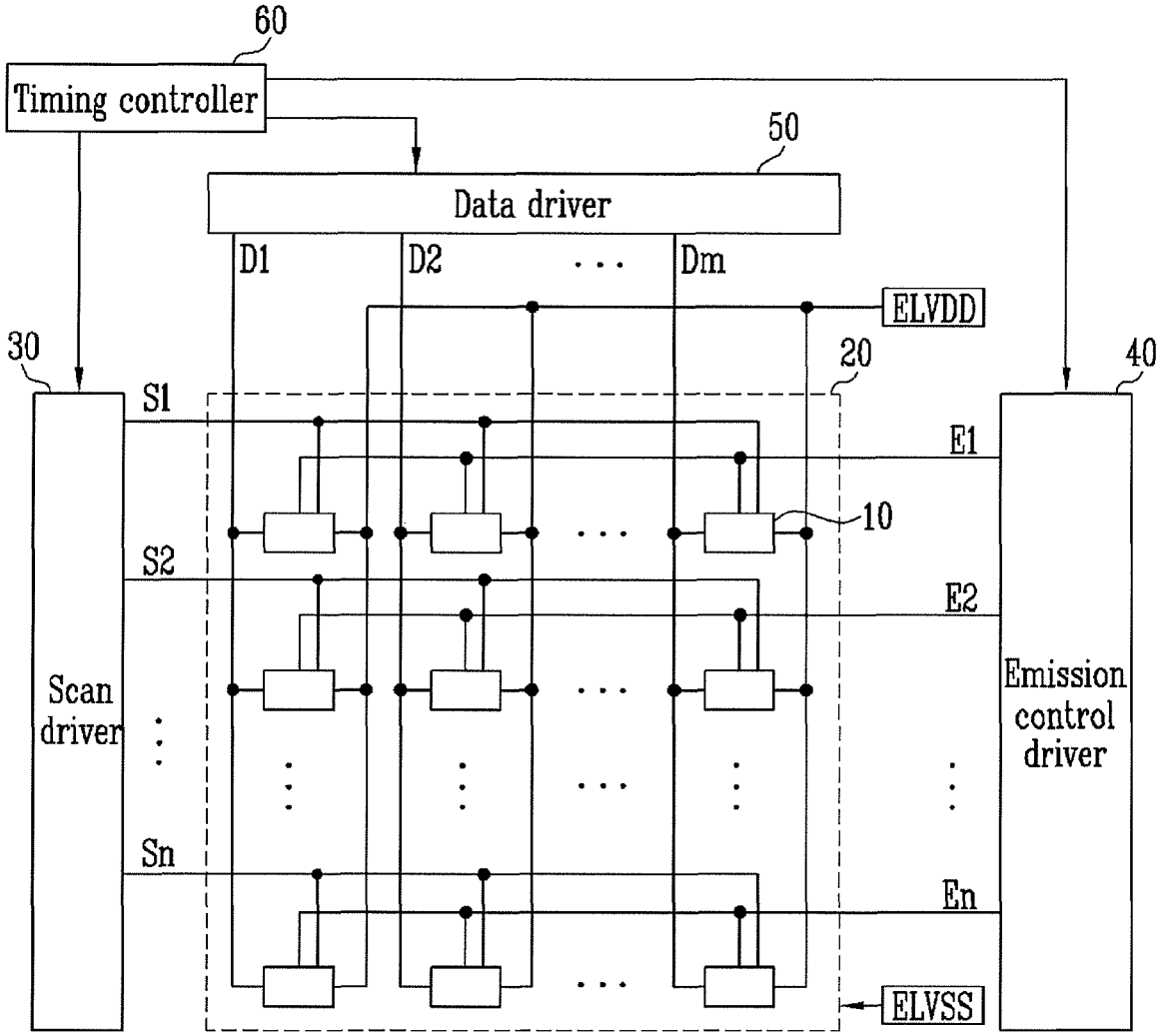
FIG. 1 is a view illustrating an organic light emitting display according to an exemplary embodiment of the present invention.

In order to address the complications related to controlling the bit of data in accordance with external light, a method of controlling the width of the emission control signals to control the brightness of the panel is provided. Since the turn-on time of pixels corresponds to the width of the emission control signals, the width of the emission control signals is controlled so that the brightness of the panel may be controlled. Therefore, the emission control driver capable of freely controlling the width of the emission control signals may be used.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more other elements. Further, some of the elements that are not essential to a complete understanding of the invention are omitted for clarity. Also, like reference numerals refer to like elements throughout.

Specific aspects of embodiments are included in the detailed description and drawings.

Characteristics of embodiments of the present invention and a method of achieving the aspects and characteristics of embodiments of the present invention will be clarified with reference to the embodiments described hereinafter in detail together with the accompanying drawings. However, the present invention is not limited to the embodiments disclosed hereinafter, but may be realized in different forms.

FIG. 1 is a view illustrating an organic light emitting display according to an exemplary embodiment of the present invention.

Referring to FIG. 1, the organic light emitting display according to the present exemplary embodiment includes a display unit 20 including pixels 10 coupled to scan lines S1 to Sn, emission control lines E1 to En, data lines D1 to Dm, a first power source ELVDD, a second power source ELVSS, a scan driver 30 for supplying scan signals to the pixels 10 through the scan lines S1 to Sn, an emission control driver 40 for supplying emission control signals to the pixels 10 through the emission control lines E1 to En, and a data driver 50 for supplying data signals to the pixels 10 through the data lines D1 to Dm. The organic light emitting display may further include a timing controller 60 for controlling the scan driver 30, the emission control driver 40, and the data driver 50.

The scan driver 30 generates the scan signals according to the control of the timing controller 60, and sequentially supplies the generated scan signals to the scan lines S1 to Sn. Then, the pixels 10 coupled to the scan lines S1 to Sn are selected (e.g., sequentially selected).

The data driver 50 generates the data signals for determining the brightness (e.g., the emission brightness components) of the pixels 10 according to the control of the timing controller 60, and supplies the generated data signals to the data lines D1 to Dm. Then, the data signals are supplied to the pixels 10 selected by the scan signals, and the pixels 10 emit light (e.g., light components) with brightness (e.g., brightness components) corresponding to the data signals supplied thereto.

Figure 2:
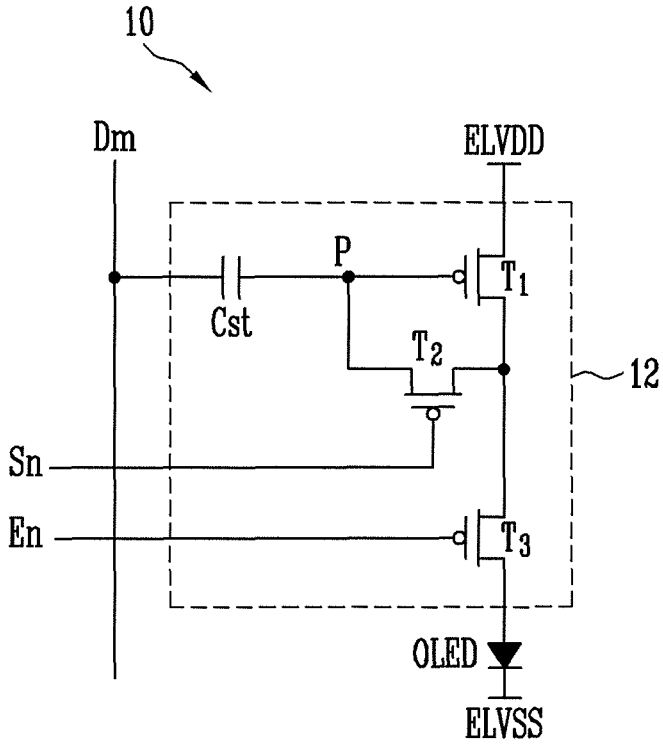
FIG. 2 is a view illustrating a pixel according to the exemplary embodiment of the present invention shown in FIG. 1.

FIG. 2 is a view illustrating a pixel according to the exemplary embodiment of the present invention shown in FIG. 1. In FIG. 2, for the sake of convenience, the pixel coupled to the $n^{th}$ scan line Sn and the $m^{th}$ data line Dm is shown.

The pixels 10 are coupled to the first power source ELVDD and the second power source ELVSS in order to generate the light components corresponding to the data signals. At this time, the first power source ELVDD may be a high potential power source, and the second power source ELVSS may be a low potential power source (for example, a ground power source) having a voltage of a lower level than the voltage of the first power source ELVDD.

Referring to FIG. 2, each of the pixels 10 includes a pixel circuit 12 coupled to an organic light emitting diode OLED, the data line Dm, the emission control line En, and the scan line Sn to control the amount of current supplied to the OLED.

An anode electrode of the OLED is coupled to the pixel circuit 12 and a cathode electrode is coupled to the second power source ELVSS. The OLED generates light with brightness (e.g., predetermined brightness) corresponding to the current supplied from the pixel circuit 12.

The pixel circuit 12 controls the current that flows from the first power source ELVDD to the second power source ELVSS via the OLED in response to the data signal supplied to the data line Dm when a scan signal is supplied to the scan line Sn.

Therefore, the pixel circuit 12 includes first to third transistors T1 to T3 and a storage capacitor Cst.

The first transistor T1, which is used as a driving transistor, generates current corresponding to the voltage between its gate electrode and its first electrode to supply the generated current to the OLED.

Therefore, the first electrode of the first transistor T1 is coupled to the first power source ELVDD, the second electrode of the first transistor T1 is coupled to a second electrode of the second transistor T2, and the gate electrode of the first transistor T1 is coupled to a node P.

A first electrode of the second transistor T2 is coupled to the node P, the second electrode of the second transistor T2 is coupled to the second electrode of the first transistor T1, and a gate electrode of the second transistor T2 is coupled to the scan line Sn.

In addition, the second transistor T2 is turned on when the scan signal is supplied from the scan line Sn to electrically couple the node P to the second electrode of the first transistor T1.

A first electrode of the third transistor T3 is coupled to the second electrode of the first transistor T1, a second electrode of the third transistor T3 is coupled to the anode electrode of the OLED, and a gate electrode of the third transistor T3 is coupled to the emission control line En.

In addition, the third transistor T3 is turned off when an emission control signal is supplied from the emission control line En to block coupling (e.g., electrical coupling) between the second electrode of the first transistor T1 and the anode electrode of the OLED.

The emission control signal turns off the third transistor T3. When the third transistor T3 is a PMOS transistor as shown in FIG. 2, a high level voltage is applied (e.g., as the emission control signal to turn off the third transistor), and when the third transistor T3 is an NMOS transistor, a low level voltage is applied (e.g., as the emission control signal to turn off the third transistor).

One terminal (e.g., a first terminal) of the storage capacitor Cst is coupled to the data line Dm and the other terminal (e.g., a second terminal) of the storage capacitor Cst is coupled to the node P.

The anode electrode of the OLED is coupled to the second electrode of the third transistor T3 and the cathode electrode of the OLED is coupled to the second power source ELVSS so that light corresponding to the driving current of the first transistor T1 is generated.

The node P is a contact point at which the gate electrode of the first transistor T1, the other terminal of the storage capacitor Cst, and the first electrode of the second transistor T2 are coupled.

The above-described pixel structure of FIG. 2 is only an embodiment of the present invention, and the pixel 10 of the present invention is not limited to the above-described pixel structure.

Figure 3:
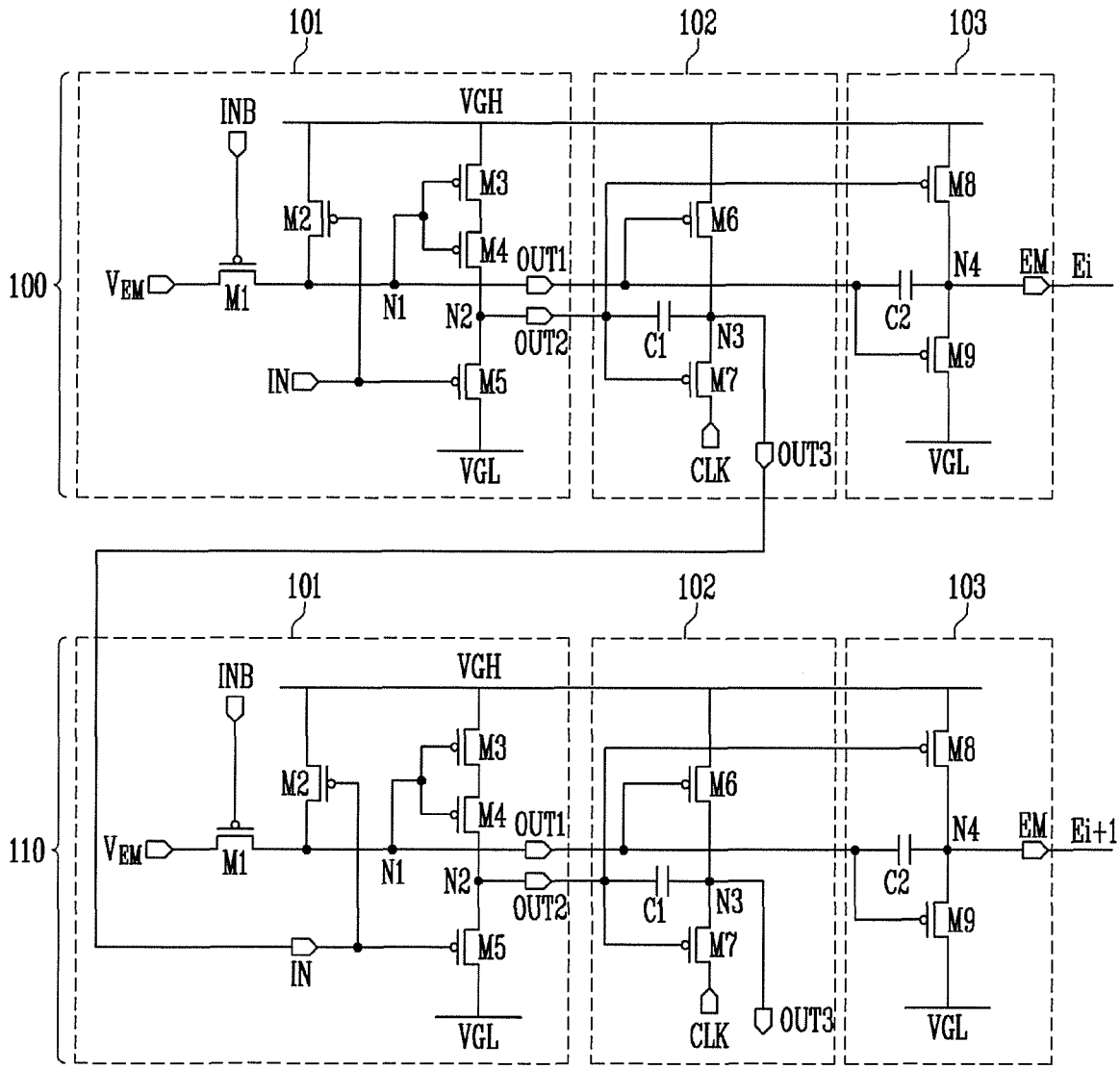
FIG. 3 is a view illustrating an emission control driver according to the exemplary embodiment of the present invention shown in FIG. 1.

FIG. 3 is a view illustrating an emission control driver according to the exemplary embodiment of the present invention shown in FIG. 1. In FIG. 3, for the sake of convenience, an $i^{th}$ (i is a natural number) stage and an $(i+1)^{th}$ stage of the emission control driver are illustrated.

The emission control driver 40 generates emission control signals according to the control of the timing controller 60, and supplies the generated emission control signals to the emission control lines E1 to En. Therefore, the timing controller 60 supplies various signals, such as a main input signal IN, a sub input signal INB, and a clock signal CLK to the emission control driver 40.

In FIG. 1, the emission control driver 40 is separated from the scan driver 30. However, in other embodiments of the present invention, the emission control driver 40 may be included in the scan driver 30.

The emission control driver 40 includes a plurality of stages coupled to the emission control lines E1 to En. For example, as illustrated in FIG. 3, an $i^{th}$ stage 100 is coupled to an $i^{th}$ control line Ei, and an $(i+1)^{th}$ stage 110 is coupled to an $(i+1)^{th}$ control line Ei+1.

Each of the stages includes a first signal processing unit 101, a second signal processing unit 102, and a third signal processing unit 103 in order to output the emission control signals. The $i^{th}$ stage 100 will be representatively described.

The first signal processing unit 101 receives an input power source $V_{EM}$, the main input signal IN, and the sub input signal INB to output a first output signal OUT1 and a second output signal OUT2.

The second signal processing unit 102 receives the first output signal OUT1, the second output signal OUT2, and the clock signal CLK to output a third output signal OUT3.

The third signal processing unit 103 receives the first output signal OUT1 and the second output signal OUT2 to output an emission control signal EM.

At this time, the signal processing units 101, 102, and 103 are coupled to a driving power source VGH and a ground power source VGL. The driving power source VGH has a high level voltage and the ground power source VGL has a lower level voltage than the driving power source VGH.

In addition, the input power source $V_{EM}$ applied to the first signal processing unit 101 may be the ground power source VGL.

The first signal processing unit 101 includes first to fifth transistors M1 to M5 in order to output the first output signal OUT1 and the second output signal OUT2.

A gate electrode of the first transistor M1 receives the sub input signal INB, a first electrode of the first transistor M1 is coupled to a first node N1, and a second electrode of the first transistor M1 is coupled to the input power source $V_{EM}$. The first transistor M1 is turned on when the sub input signal INB is supplied to apply the input power source $V_{EM}$ to the first node N1.

The sub input signal INB for turning on the first transistor M1 has a low level voltage when the first transistor M1 is a PMOS transistor, as shown in FIG. 3, and has a high level voltage when the first transistor M1 is an NMOS transistor.

A gate electrode of the second transistor M2 receives the main input signal IN, a first electrode of the second transistor M2 is coupled to the first node N1, and a second electrode of the second transistor M2 is coupled to the driving power source VGH. The second transistor M2 is turned on when the main input signal IN is supplied to transmit the driving power source VGH to the first node N1.

A gate electrode of the third transistor M3 is coupled to the first node N1, a first electrode of the third transistor M3 is coupled to the driving power source VGH, and a second electrode of the third transistor M3 is coupled to a first electrode of a fourth transistor M4.

A gate electrode of the fourth transistor M4 is coupled to the first node N1, the first electrode of the fourth transistor M4 is coupled to the second electrode of the third transistor M3, and a second electrode of the fourth transistor M4 is coupled to a second node N2.

When the third transistor M3 and the fourth transistor M4 are PMOS transistors as shown in FIG. 3, the third transistor M3 and the fourth transistor M4 are turned on by the input power source $V_{EM}$ having a low level voltage to transmit the driving power source VGH to the second node N2, and may be turned off by the input power source $V_{EM}$ having a high level voltage.

A gate electrode of a fifth transistor M5 receives the main input signal IN, a first electrode of the fifth transistor M5 is coupled to the second node N2, and a second electrode of the fifth transistor M5 is coupled to the ground power source VGL. The fifth transistor M5 is turned on when the main input signal IN is supplied to transmit the ground power source VGL to the second node N2.

The main input signal IN for turning on the second transistor M2 and the fifth transistor M5 has a low level voltage when the transistors M2 and M5 are PMOS transistors, as shown in FIG. 3, and has a high level voltage when the transistors M2 and M5 are NMOS transistors.

The first signal processing unit 101 outputs the first output signal OUT1 to the first node N1 to supply the first output signal OUT1 to the second signal processing unit 102 and the third signal processing unit 103, and outputs the second output signal OUT2 to the second node N2 to supply the second output signal OUT2 to the second signal processing unit 102 and the third signal processing unit 103.

The first output signal OUT1 may be the input power source $V_{EM}$ or the driving power source VGH, and the second output signal OUT2 may be the ground power source VGL or the driving power source VGH.

The second signal processing unit 102 includes sixth and seventh transistors M6 and M7 (which may be referred to as first and second transistors, respectively, in some claims) and a first capacitor C1 in order to output the third output signal OUT3.

A gate electrode of the sixth transistor M6 is coupled to the first node N1, a first electrode of the sixth transistor M6 is coupled to the driving power source VGH, and a second electrode of the sixth transistor M6 is coupled to a third node N3. The sixth transistor M6 is turned on when the input power source $V_{EM}$ of a low level voltage is supplied to the first node N1 to transmit the driving power source VGH to the third node N3, and is turned off when the driving power source VGH is supplied to the first node N1.

A gate electrode of the seventh transistor M7 is coupled to the second node N2, a first electrode of the seventh transistor M7 is coupled to the third node N3, and a second electrode of the seventh transistor M7 receives the clock signal CLK. When the ground power source VGL is supplied to the second node N2, the seventh transistor M7 is turned on to transmit the clock signal CLK to the third node N3, and is turned off when the driving power source VGH is supplied to the second node N2.

The second signal processing unit 102 outputs the third output signal OUT3 to the third node N3. The third output signal OUT3 is supplied as the main input signal IN of the next stage. That is, the third output signal OUT3 output from the $i^{th}$ stage 100 is input as the main input signal IN to the first signal processing unit 101 of the $(i+1)^{th}$ stage 110.

The third signal processing unit 103 includes eighth and ninth transistors M8 and M9 (which may be referred to as first and second transistors, respectively, in some claims) and a second capacitor C2 in order to output the emission control signal EM.

A gate electrode of the eighth transistor M8 is coupled to the second node N2, a first electrode of the eighth transistor M8 is coupled to the driving power source VGH, and a second electrode of the eighth transistor M8 is coupled to a fourth node N4 (which may be referred to as a third node in some claims). When the ground power source VGL is supplied to the second node N2, the eighth transistor M8 is turned on to transmit the driving power source VGH to the fourth node N4, and is turned off when the driving power source VGH is supplied to the second node N2.

A gate electrode of the ninth transistor M9 is coupled to the first node N1, a first electrode of the ninth transistor M9 is coupled to the fourth node N4, and a second electrode of the ninth transistor M9 is coupled to the ground power source VGL. When the low level input power source $V_{EM}$ is supplied to the first node N1, the ninth transistor M9 is turned on to transmit the ground power source VGL to the fourth node N4, and is turned off when the driving power source VGH is supplied to the first node N1.

The second capacitor C2 is coupled between the first node N1 and the fourth node N4.

The third signal processing unit 103 outputs the emission control signal EM to the fourth node N4, and the output emission control signal EM is supplied to the $i^{th}$ control line Ei.

The first node N1 is a contact point between the first electrode of the first transistor M1, the first electrode of the second transistor M2, the gate electrode of the third transistor M3, the gate electrode of the fourth transistor M4, the gate electrode of the sixth transistor M6, the gate electrode of the ninth transistor M9, and one terminal of the second capacitor C2.

The second node N2 is a contact point between the second electrode of the fourth transistor M4, the first electrode of the fifth transistor M5, the gate electrode of the seventh transistor M7, the gate electrode of the eighth transistor M8, and one terminal of the first capacitor C1.

The third node N3 is a contact point between the second electrode of the sixth transistor M6, the first electrode of the seventh transistor M7, and the other terminal of the first capacitor C1.

The fourth node N4 is a contact point between the second electrode of the eighth transistor M8, the first electrode of the ninth transistor M9, and the other terminal of the second capacitor C2.

It is well known to those skilled in the art that the above-described first to ninth transistors M1 to M9 may be NMOS transistors instead of the PMOS transistors shown in FIG. 3.

Figure 4:
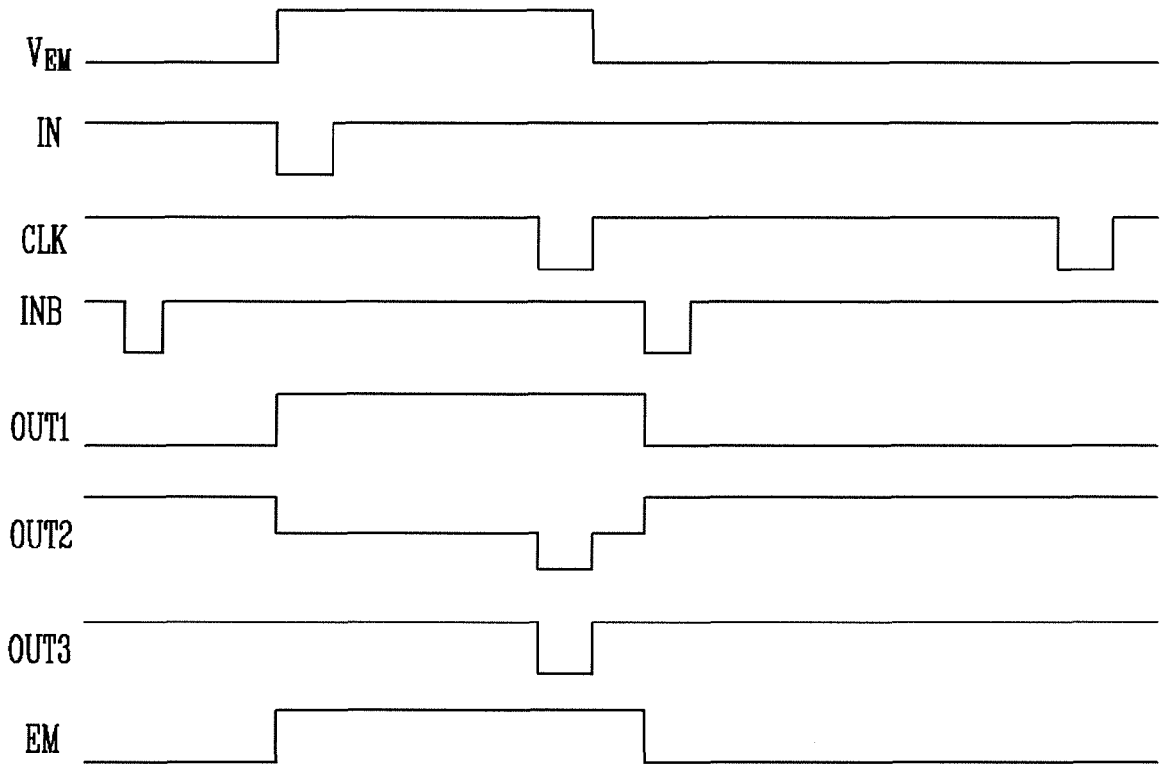
FIG. 4 is a waveform chart illustrating the operation of the emission control driver of the embodiment shown in FIG. 3.

FIG. 4 is a waveform chart showing an operation of the emission control driver of FIG. 3. With reference to FIGS. 3 and 4, the operations of signal processing units will be described.

First, when the sub input signal INB is supplied while the low level input power source $V_{EM}$ is supplied, the first transistor M1 is turned on and the input power source $V_{EM}$ is applied to the first node N1. At this time, since the main input signal IN is not supplied, the second transistor M2 and the fifth transistor M5 are turned off.

Since the low level input power source $V_{EM}$ is supplied to the first node N1, the third transistor M3 and the fourth transistor M4 are turned on so that the driving power source VGH is applied to the second node N2.

Since the low level input power source $V_{EM}$ is supplied to the first node N1, the sixth transistor M6 is turned on so that the driving power source VGH is applied to the third node N3, and the ninth transistor M9 is turned on so that the ground power source VGL is applied to the fourth node N4.

Therefore, the low level input power source $V_{EM}$ is output as the first output signal OUT1, the driving power source VGH is output as the second output signal OUT2 and the third output signal OUT3, and the ground power source VGL is output as the emission control signal EM.

Then, the main input signal IN is supplied, the second transistor M2 is turned on so that the driving power source VGH is applied to the first node N1, and the fifth transistor M5 is turned on so that the ground power source VGL is applied to the second node N2.

Therefore, the driving power source VGH applied to the first node N1 is output as the first output signal OUT1.

The driving power source VGH is applied to the first node N1 so that the third transistor M3, the fourth transistor M4, the sixth transistor M6, and the ninth transistor M9 are turned off.

In addition, the ground power source VGL is applied to the second node N2 so that the seventh transistor M7 and the eighth transistor M8 are turned on, and that the ground power source VGL is output as the second output signal OUT2.

The seventh transistor M7 is turned on so that the high level clock signal CLK is applied to the third node N3 and the high level clock signal CLK is output as the third output signal OUT3.

The eighth transistor M8 is turned on so that the driving power source VGH is applied to the fourth node N4, and that the driving power source VGH is output as the emission control signal EM.

When the high level clock signal transitions to a low level while the high level emission control signal EM is output, the voltage of the third node N3 is reduced so that the voltage of the third output signal OUT3 is reduced to the drop (e.g., low) voltage of the clock signal CLK.

Therefore, the third output signal OUT3 transitioned to a low level is supplied to the main input signal IN of the next stage.

When the sub input signal INB is supplied while the high level emission control signal EM is output, since the ground power source VGL is output as the emission control signal EM, the emission control signal EM has a low level voltage.

Therefore, the width of the emission control signal EM (the width of a high level voltage) may be freely controlled using the main input signal IN and the sub input signal INB.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An emission control driver comprising:

a first signal processing unit for receiving an input power from an input power source, a main input signal, and a sub input signal, and for outputting a first output signal and a second output signal, wherein each of the first and second output signals is generated according to both of the main input signal and the sub input signal;

a second signal processing unit for receiving the first output signal, the second output signal, and a clock signal, and for outputting a third output signal; and a third signal processing unit for receiving the first output signal and the second output signal, and for outputting an emission control signal, a width of the emission control signal being controlled using the main input signal and the sub input signal.

2. The emission control driver as claimed in claim 1, wherein the signal processing units are coupled to a driving power source, and the first and third signal processing units are coupled to a ground power source.

3. The emission control driver as claimed in claim 2, wherein the input power source is the same as the ground power source.

4. The emission control driver as claimed in claim 1, wherein the first signal processing unit comprises:

a first transistor comprising:

a gate electrode configured to receive the sub input signal;

a first electrode coupled to a first node; and a second electrode coupled to the input power source;

a second transistor comprising:

a gate electrode configured to receive the main input signal;

a first electrode coupled to the first node; and a second electrode coupled to a driving power source;

a third transistor comprising:

a gate electrode coupled to the first node;

a first electrode coupled to the driving power source; and a second electrode;

a fourth transistor comprising:

a gate electrode coupled to the first node;

a first electrode coupled to the second electrode of the third transistor; and a second electrode coupled to a second node; and a fifth transistor comprising:

a gate electrode configured to receive the main input signal;

a first electrode coupled to the second node; and a second electrode coupled to a ground power source, wherein the first output signal is configured to be output to the first node, and wherein the second output signal is configured to be output to the second node.

5. The emission control driver as claimed in claim 4, wherein the second signal processing unit comprises:

a sixth transistor comprising:

a gate electrode coupled to the first node;

a first electrode coupled to the driving power source; and a second electrode coupled to a third node;

a seventh transistor comprising:

a gate electrode coupled to the second node;

a first electrode coupled to the third node; and a second electrode configured to receive the clock signal; and a first capacitor coupled between the second node and the third node, wherein the third output signal is output to the third node.

6. The emission control driver as claimed in claim 5, wherein the third signal processing unit comprises:

an eighth transistor comprising:

a gate electrode coupled to the second node;

a first electrode coupled to the driving power source; and a second electrode coupled to a fourth node;

a ninth transistor comprising:

a gate electrode coupled to the first node;

a first electrode coupled to the fourth node; and a second electrode coupled to the ground power source; and a second capacitor coupled between the first node and the fourth node, wherein the emission control signal is output to the fourth node.

7. The emission control driver as claimed in claim 1, wherein the second signal processing unit comprises:

a sixth transistor comprising:

a gate electrode coupled to a first node;

a first electrode coupled to a driving power source; and a second electrode coupled to a third node;

a seventh transistor comprising:

a gate electrode coupled to a second node;

a first electrode coupled to the third node; and a second electrode configured to receive the clock signal; and a first capacitor coupled between the second node and the third node, wherein the third output signal is output to the third node.

8. The emission control driver as claimed in claim 1, wherein the third signal processing unit comprises:

an eighth transistor comprising:

a gate electrode coupled to a second node;

a first electrode coupled to a driving power source; and a second electrode coupled to a third node;

a ninth transistor comprising:

a gate electrode coupled to a first node;

a first electrode coupled to the third node; and a second electrode coupled to a ground power source; and a second capacitor coupled between the first node and the third node, wherein the emission control signal is output to the third node.

9. An organic light emitting display, comprising:

a display unit comprising pixels coupled to scan lines, emission control lines, data lines, a first power source, and a second power source;

a scan driver for supplying scan signals to the pixels through the scan lines;

an emission control driver comprising a plurality of stages coupled to the emission control lines and for supplying emission control signals to the pixels through the emission control lines; and a data driver for supplying data signals to the pixels through the data lines, wherein each of the stages comprises:

a first signal processing unit for receiving an input power source, a main input signal, and a sub input signal, and for outputting a first output signal and a second output signal, wherein each of the first and second output signals is generated according to both of the main input signal and the sub input signal;

a second signal processing unit for receiving the first output signal, the second output signal, and a clock signal and for outputting a third output signal; and a third signal processing unit for receiving the first output signal and the second output signal, and for outputting an emission control signal, a width of the emission control signal being controlled using the main input signal and the sub input signal.

10. The organic light emitting display as claimed in claim 9, wherein each of the signal processing units is coupled to a driving power source, and wherein the first and third signal processing units are coupled to a ground power source.

11. The organic light emitting display as claimed in claim 10, wherein the input power source is the same as the ground power source.

12. The organic light emitting display as claimed in claim 9, wherein an $i^{th}$ stage (i is a natural number) from among the plurality of stages is configured to output the third output signal as the main input signal of an $(i+1)^{th}$ stage from among the plurality of stages.

13. The organic light emitting display as claimed in claim 9, wherein the first signal processing unit comprises:

a first transistor comprising:

a gate electrode configured to receive the sub input signal;

a first electrode coupled to a first node; and a second electrode coupled to the input power source;

a second transistor comprising:

a gate electrode configured to receive the main input signal;

a first electrode coupled to the first node; and a second electrode coupled to a driving power source;

a third transistor comprising:

a gate electrode coupled to the first node;

a first electrode coupled to the driving power source; and a second electrode;

a fourth transistor comprising:

a gate electrode coupled to the first node;

a first electrode coupled to the second electrode of the third transistor; and a second electrode coupled to a second node; and a fifth transistor comprising:

a gate electrode configured to receive the main input signal;

a first electrode coupled to the second node; and a second electrode coupled to a ground power source, wherein the first output signal is output to the first node, and wherein the second output signal is output to the second node.

14. The organic light emitting display device as claimed in claim 9, wherein the second signal processing unit comprises:

a first transistor comprising:

a gate electrode coupled to a first node;

a first electrode coupled to a driving power source; and
a second electrode coupled to a third node;

a second transistor comprising:

a gate electrode coupled to a second node;
a first electrode coupled to the third node; and
a second electrode configured to receive the clock signal; and a first capacitor coupled between the second node and the third node, wherein the third output signal is output to the third node.

15. The organic light emitting display as claimed in claim 9, wherein the third signal processing unit comprises:

a first transistor comprising:

a gate electrode coupled to a second node;
a first electrode coupled to a driving power source; and
a second electrode coupled to a third node;

a second transistor comprising:

a gate electrode coupled to a first node;
a first electrode coupled to the third node; and
a second electrode coupled to a ground power source; and a second capacitor coupled between the first node and the third node, wherein the emission control signal is output to the third node.

* * * * *